US007555860B1

(12) United States Patent
Ivanitch

(10) Patent No.: US 7,555,860 B1
(45) Date of Patent: Jul. 7, 2009

(54) HELMET DISPLAY

(76) Inventor: Michael T. Ivanitch, 2412 Circle Dr., Wake Forest, NC (US) 27587

( * ) Notice: Subject to any disclaimer, the term of this patent is extended or adjusted under 35 U.S.C. 154(b) by 523 days.

(21) Appl. No.: 11/173,531

(22) Filed: Jul. 1, 2005

Related U.S. Application Data

(60) Provisional application No. 60/598,376, filed on Aug. 2, 2004.

(51) Int. Cl.
*A47G 7/00* (2006.01)

(52) U.S. Cl. ..... 40/657

(58) Field of Classification Search ..... 40/657, 40/673, 663, 620, 607.13; 211/85.7, 30; 2/422, 425; 434/392, 399, 407
See application file for complete search history.

(56) References Cited

U.S. PATENT DOCUMENTS

| | | | | | |
|---|---|---|---|---|---|
| 1,394,715 | A | * | 10/1921 | Culver | 235/90 |
| 3,761,094 | A | * | 9/1973 | Belisle | 273/293 |
| 3,949,506 | A | | 4/1976 | Benkowski | |
| D240,365 | S | | 6/1976 | Bennett | |
| 4,258,488 | A | | 3/1981 | Schienbein | |
| 4,356,650 | A | | 11/1982 | Antonczyk et al. | |
| 4,599,752 | A | * | 7/1986 | Mitchell | 2/425 |
| D291,850 | S | | 9/1987 | Perkins et al. | |
| 4,723,663 | A | * | 2/1988 | Learn | 211/59.2 |
| 4,831,754 | A | | 5/1989 | Tallent | |
| 5,176,521 | A | * | 1/1993 | McRae | 434/407 |
| 5,407,377 | A | | 4/1995 | Paszkiewiez et al. | |
| 5,573,405 | A | * | 11/1996 | Evans | 434/238 |
| D393,603 | S | | 4/1998 | Cerisano | |
| 5,819,457 | A | | 10/1998 | Parker | |
| 5,836,459 | A | * | 11/1998 | Nezwek et al. | 211/50 |
| 6,170,185 | B1 | * | 1/2001 | Donofrio, Jr. | 40/800 |
| 6,315,375 | B1 | | 11/2001 | Reeves et al. | |
| 6,648,283 | B2 | * | 11/2003 | Chase et al. | 248/125.1 |
| 6,718,559 | B1 | * | 4/2004 | Davidson | 2/422 |
| 6,722,070 | B2 | | 4/2004 | Ribaudo | |
| 2001/0000553 | A1 | | 5/2001 | Donofrio, Jr. | |
| 2002/0108286 | A1 | | 8/2002 | Brockley et al. | |

OTHER PUBLICATIONS

Sports Fan Shop online catalog, Riddell Pocket Pro Sets and Displays, Sports Fan Shop, three pages from Internet, 2002.
Riddell Fan Shop online catalog, showing pocket size helmet display cases, four pages from Internet, date unknown.
ebay posting No. 5189452102, "Collectable NFL Football Pocket Pro Helmet Display", two pages, posted Apr. 23, 2005.

* cited by examiner

*Primary Examiner*—William L. Miller
(74) *Attorney, Agent, or Firm*—Miller Patent Services; Jerry A. Miller

(57) ABSTRACT

A display device for displaying sport helmets consistent with certain embodiments has a substrate that includes a planar surface. A plurality of pegs are attached to the substrate's planar surface and protrude from the surface of the substrate, each peg has an outer diameter that is suitably sized to create an interference fit with an air hole in the sport helmet, and by the interference fit attach the helmet to the display device. The plurality of pegs are attached to the substrate's planar surface disposed at an angle with respect to the plane of the substrate, and with the plurality of pegs being oriented parallel with a plane of horizontal orientation of the display device. Preferably, the plurality of pegs are arranged in rows and columns exhibiting vertical and horizontal symmetry. The display device is especially suitable for miniature helmets such as pocket sized football helmets. This abstract is not to be considered limiting, since other embodiments may deviate from the features described in this abstract.

28 Claims, 3 Drawing Sheets

FIG. 6
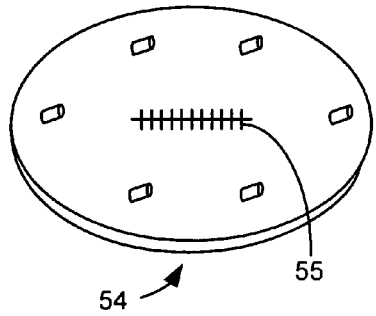
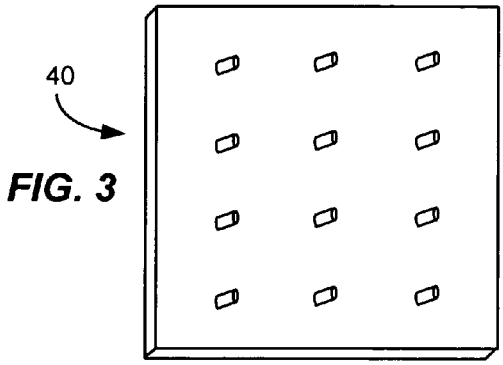
FIG. 3
FIG. 7
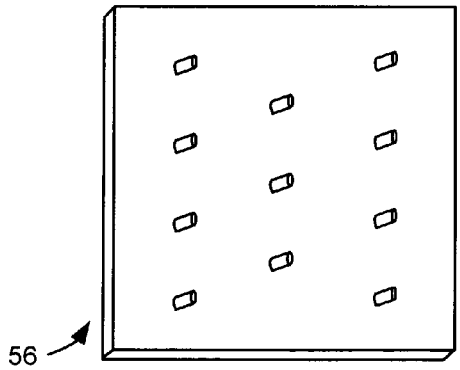
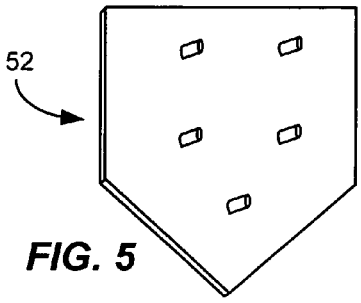
FIG. 5
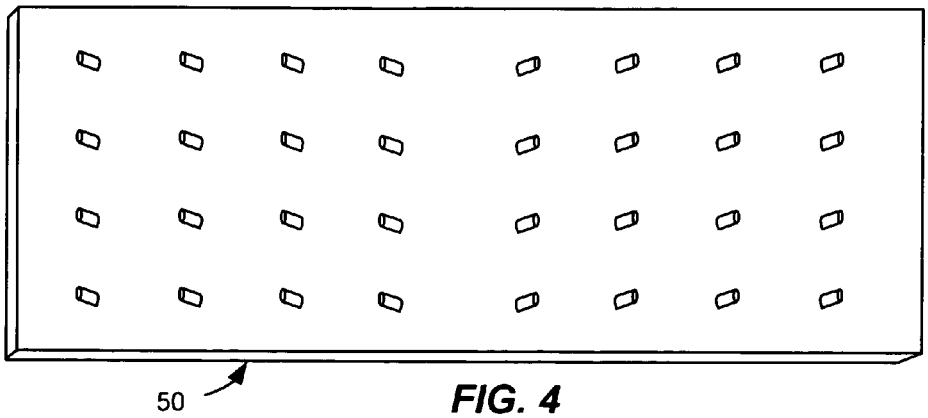
FIG. 4

HELMET DISPLAY

CROSS REFERENCE TO RELATED DOCUMENTS

This application is related to and claims priority benefit of U.S. Provisional Patent Application Ser. No. 60/598,376, filed Aug. 2, 2004 to Michael Thomas Ivanitch, which is hereby incorporated herein by reference.

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever.

BACKGROUND

Miniature versions of sports helmets are a popular collectable. One example of such helmets are marketed by Riddell, Inc., 3670 N. Milwaukee Ave., Chicago, Ill. 60641, for example as the Pocket Pro™ brand pocket size miniature football helmets. Such helmets are miniature versions of the helmets used by sports teams and generally carry the team logo. Several versions of these helmets exist in the marketplace for professional sports teams as well as collegiate sports teams.

Riddell, Inc. and others also market display cases for these helmets. Such display cases are essentially acrylic shelves with dividers to provide individual compartments. Both the acrylic display case made by Riddell, Inc. and most generic multi-level collectible shelf units are heavy, don't hold the helmets in place, and partially obstruct the view of each helmet. Thus. if the case is jarred or moved, the helmets can readily fall Out and possibly be damaged.

BRIEF DESCRIPTION OF THE DRAWINGS

Certain exemplary embodiments illustrating organization and method of operation, together with objects and advantages may be best understood by reference to the detailed description that follows taken in conjunction with the accompanying drawings in which:

FIG. 3 illustrates a display device suitable for holding up to twelve helmets in a manner consistent with certain embodiments of the present invention.

FIG. 4 illustrates a display device suitable for holding up to thirty two helmets in a manner consistent with certain embodiments of the present invention.

FIG. 5 illustrates a five sided display device suitable for holding up to five helmets in a manner consistent with certain embodiments of the present invention.

FIG. 6 illustrates an oval or football shaped display device suitable for holding up to six helmets in a manner consistent with certain embodiments of the present invention.

FIG. 7 illustrates a display device suitable for holding up to eleven helmets in a manner consistent with certain embodiments of the present invention.

DETAILED DESCRIPTION

Figure 1:
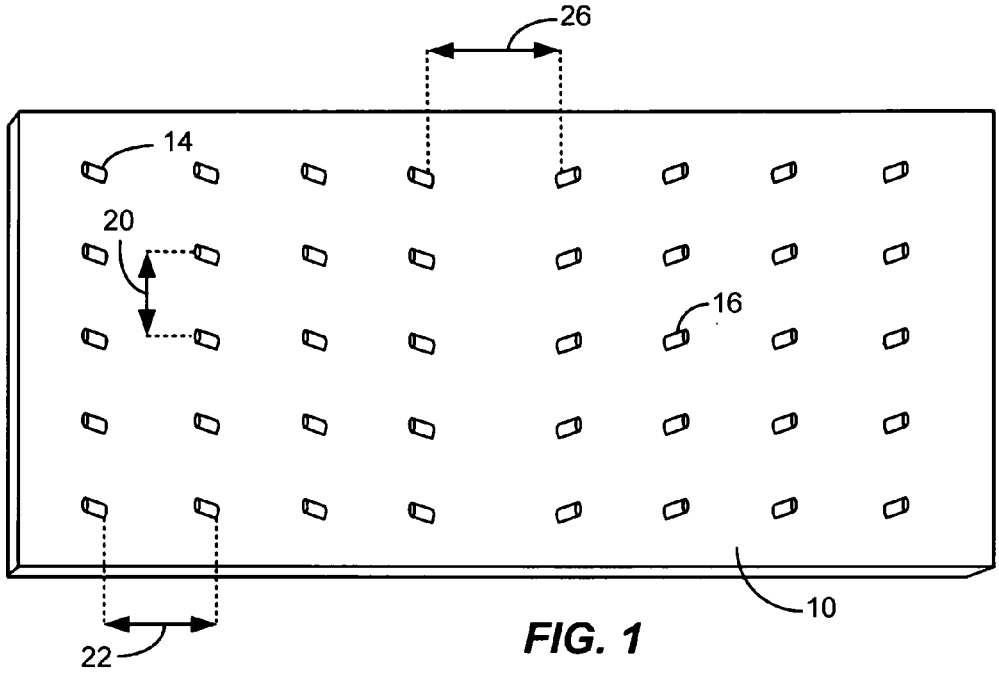
FIG. 1 illustrates a helmet display device that holds up to 32 helmets in a manner consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). Reference throughout this document to "one embodiment", "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

In embodiments consistent with the present invention, miniature collectible sports helmets can be displayed (Such as "Pocket Pro by Riddell" football helmets) on a wall or other flat surface. Such embodiments give owners of such helmets an organized, simple and decorative way to showcase their collectible sports helmets. Additionally, certain embodiments consistent with the invention provide a lighter-weight and less-bulky alternative that keeps the helmets in a uniform, stationary position. Further, such embodiments also allow a nearly completely unobstructed view of the collectible helmets.

Turning now to FIG. 1, an embodiment of the helmet display device consistent with the present invention is shown. In this embodiment, the display device uses a flat board. such as plywood, wood, fiberboard, plastic or any other suitable substrate 10 with rows and columns of embedded pegs (e.g., dowels) such as 14 and 16 protruding outward. In certain embodiments, hardwood plywood is used for the substrate with the pegs being round and extending approximately ¼ inch from the front surface of the substrate.

In this exemplary embodiment, the pegs are arranged vertically in rows that are 2 ⅜ inches apart as shown by reference 20 and horizontally in columns that are 2 ⅝ inches apart as shown by reference 22 and the pegs protrude from the surface at an angle θ° that differs from 90 degrees (although 90 degrees could be used without departing from embodiments consistent with the present invention). In this particular embodiment. pegs such as 16 on the right half of the display device point slightly to the left, while pegs such as 14 point slightly to the right. This enables the helmets to have vertical symmetry about the center of the display device and face each other. Thus, for example, teams from one league, division or conference could be displayed on the left, while teams from another league, division or conference could be displayed on the right as if they are "facing off", or they can be otherwise displayed as desired. In this exemplary embodiment, the center columns of pegs are separated by a slightly greater spacing as depicted by 26, for example, 3 inches. In this embodiment, up to forty helmets can be displayed. The substrate 10 can be approximately used that measures approximately 24 inches wide by approximately 13 inches high. Of course, other dimensions and angular orientations can be used without departing from embodiments consistent with the present invention. Protective pads (not shown) can be placed on the rear surface of substrate 10 to prevent the substrate from scuffing walls.

Figure 2:
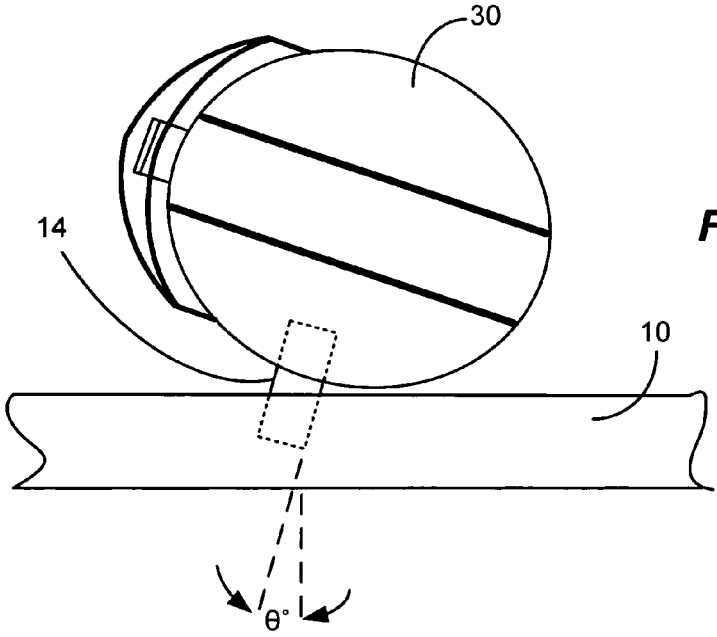
FIG. 2 is a top detail view depicting the mechanism for holding a single helmet in place in a manner consistent with certain embodiments of the present invention.

The details of attachment of the helmet to the display device are depicted in FIG. 2. In this top view, a miniature helmet 30 is attached to peg 14. The helmet's ear hole for certain of the pocket size football helmets has been found to be approximately ¼ inch in diameter. Accordingly, high quality (i.e., accurately sized) ¼ inch diameter hardwood dowel stock has been found to produce an interference fit with the air hole (also called ear hole, and is located adjacent the location of a player's ear when the helmet is worn) of the helmet to hold the helmet in place. Further, it is preferred that the angle θ° be approximately ±15° (approximately ±75° from the plane of the substrate and parallel with a plane of horizontal orientation of the display (e.g., a plane extending horizontally from a row of pegs, or other horizontal reference in the display or with respect to the display, such as a floor or ceiling), for example, within approximately ±5 degrees). This angle provides the benefit of slightly angling the front of helmet 30 outward for a more appealing view, as well as causing the rear of the helmet to contact the substrate 10 to facilitate tighter engagement of the helmet 30 with the peg 14. This may also assist with compensation for wear on the peg 14 or ear hole of helmet 30 if the helmet 30 is repeatedly removed and replaced, or if the ear hole is slightly oversized. Additionally, this angle is enough to prevent the face guard from touching the substrate. Of course, other angles could also be used without departing from embodiments consistent with the present invention, but the 15 degree viewing angle is believed approximately optimal for display.

The display's front-facing surface can be either undecorated or adorned with designs, graphics, textures or colors. On the back of the display are two hanging hooks or holes or other hanging mechanism. In this example, a pair of hooks or holes spaced 16 inches apart are provided for mounting on a wall (not shown). The display could also be rested on a large plate stand for placement on a shelf, table or other flat surface.

The helmet display uses a friction fit (i.e., an interference fit) to keep the helmets in place (i.e. the pegs fit snugly into the air hole of the helmets with just enough friction to hold the helmet in a stationary position). In one embodiment, wooden pegs are used in a hardwood plywood substrate. The pegs are glued in place within holes drilled at a 75° angle in the plywood, that is, approximately 15 degrees from perpendicular to the substrate. The pegs need only protrude from the surface of the substrate 10 by about ¼ inch in order to effectively hold the pocket size helmets in place. This should not be considered limiting since other materials, angles and peg-to-substrate connection techniques could also be used.

It is noted that certain miniature collectable helmets such as the Revolution™ pocket size by Riddell, Inc. has air holes that deviate from the ¼ inch diameter air holes found in the standard Pocket Pro™ by Riddell, Inc. helmets. In this example helmet, the air holes are actually triangular shaped with rounded corners. It has been found that the same concept can be applied, however, by use of a circular peg made of high quality 3⁄16 inch hardwood dowel stock. Thus, by appropriately sizing the pegs for a suitable friction fit, helmets with various configurations of air holes can be similarly displayed using display devices consistent with embodiments of the present invention. In this example, the round pegs work well even though the air hole is triangular. In other embodiments, similarly non-round pegs or holes could be mated with non-round holes or pegs, so long as an interference fit is achieved.

The helmet display can be provided in any number of helmet arrangements. For example, a 12-helmet display can be provided that measures approximately 9 ¾ inches wide by 10 ¾ inches high. Such an arrangement is depicted as display 40 of FIG. 3. In this embodiment. all of the pegs are angled in the same direction so that mounted helmets will all face the same direction.

Another variation is depicted in FIG. 4 as display 60 which can display up to 32 helmets. This embodiment again uses an arrangement of pegs that are aligned such that helmets on vertically opposite sides of the substrate will face one another when the helmets are installed. In this case, pegs to the left of the figure are oriented 15° to the left of perpendicular, and pegs to the right of the figure are oriented 15° to the right of perpendicular. The lengths of all of the pegs are oriented parallel with the horizon, i.e., the plane of horizontal orientation of the display. So, one could consider, for example the left side to be −15° with respect to perpendicular to the substrate and the right side to be +15° with respect to perpendicular to the substrate. In this embodiment, the display substrate can be approximately 24 inches wide by 10 ¾ inches high. Other arrangements, including differing numbers of rows or columns, or arrangements that do not use the particular row and column format disclosed, will occur to those skilled in the art upon consideration of these examples.

Upon consideration of the present disclosure, those skilled in the art will appreciate that any suitable arrangement of pegs can be used without limitation. For example, larger arrays of, for example, 12×12 pegs can be provided to display very large collections. Moreover, display devices sized according to the size of a particular conference, league or division, etc. can be devised. Such display devices can have pegs arranged in any suitable configuration, be it in symmetrical rows and columns as shown, or any other configuration without limitation.

FIG. 5 illustrates a variation in which the substrate provides for a five sided display device 52 suitable for holding up to five helmets in a manner consistent with certain embodiments of the present invention. Such a shape may also be suitable for baseball helmet displays since the shape is reminiscent of a home plate.

FIG. 6 illustrates another variation using an oval or football shaped display device 54 suitable for holding up to six helmets in a manner consistent with certain embodiments of the present invention. Indicia 55 can be applied to suggest the laces of a football. Thus, as depicted in displays 52 and 54 the substrate can be shaped in the shape of the outline of a sport related article such as a home plate, a football, an athletic field, a baseball, a baseball glove, a baseball bat, a hockey stick, etc. Such substrates may or may not be adorned with indicia giving the shape an appearance that is even more suggestive of the sport related article (e.g., laces of a football 55 or baseball can be painted on or applied as a decal) thereby reinforcing the similarity of the shape to the outline of the sport related article.

FIG. 7 illustrates a display device 56 suitable for holding up to eleven helmets in a manner consistent with certain embodiments of the present invention. In this example, the columns are staggered to further illustrate that the invention is not restricted to rows and columns of peg shapes. Other embodiments will occur to those skilled in the art upon consideration of the present teaching.

Figure 8:
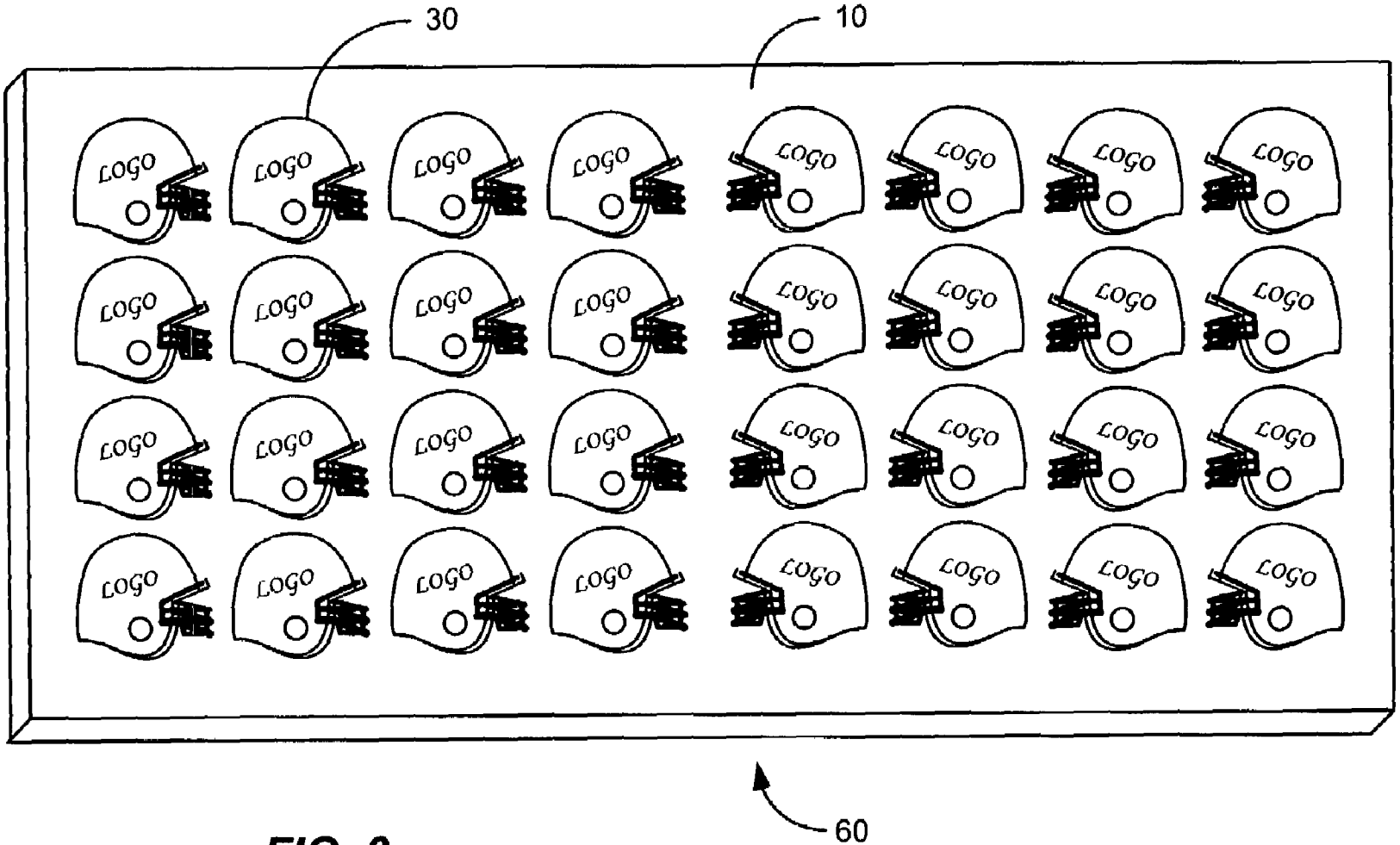
FIG. 8 illustrates a display device holding forty helmets consistent with certain embodiments of the present invention.

FIG. 8 depicts a display 60 consistent with embodiments of the present invention in which forty helmets 30 are displayed. As previously mentioned, this display arrangement (which corresponds to the illustration of FIG. 1) displays half of the helmets facing left and the other half facing right with the two halves facing one another.

Thus, in accordance with certain embodiments consistent with the present invention, a display device for displaying sport helmets has a substrate. At least one peg is attached to the substrate and protrudes from a surface of the substrate, each peg having an outer dimension that is suitably sized to create an interference fit with an air hole in the helmet, so that by the interference fit the helmet can be attached to the display device. Preferably, the substrate is planar or includes a planar surface, and the at least one peg is attached to the planar surface.

In certain embodiments, a first and second plurality of pegs are attached to the substrate's surface, and a first plurality of pegs are disposed at a first angle with respect to the plane of the substrate, and the second plurality of pegs are disposed at a second angle with respect to the substrate. In certain embodiments, the first and second angles are oriented so that helmets mounted to the first plurality of pegs face helmets mounted to the second plurality of pegs. The pegs can be arranged in rows and columns exhibiting either vertical or horizontal symmetry or both.

In another embodiment, a display device for displaying sport helmets has a substrate that includes a planar surface. A plurality of pegs are attached to the substrate's planar surface and protrude from the surface of the substrate, each peg having an outer dimension that is suitably sized to create an interference fit with an air hole in the helmet, so that by the interference fit the helmet can be attached to the display device. The plurality of pegs are attached to the substrate's planar surface disposed at an angle with respect to the plane of the substrate, and with the plurality of pegs being oriented parallel with a plane of horizontal orientation of the display device. The helmets can be oriented such that helmets mounted to the first plurality of pegs face helmets mounted to the second plurality of pegs. The pegs can be arranged in rows and columns exhibiting either vertical or horizontal symmetry or both or neither.

In accordance with other embodiments, a display device for displaying sport helmets has a substrate that includes a planar surface. A plurality of pegs are attached to the substrate's planar surface and protrude from the surface of the substrate, each peg has an outer dimension that is suitably sized to create an interference fit with an air hole in the sport helmet, so that by the interference fit the helmet can be attached to the display device. The plurality of pegs are attached to the substrate's planar surface disposed at an angle with respect to the plane of the substrate, and with the plurality of pegs being oriented parallel with a plane of horizontal orientation of the display device. Preferably, the plurality of pegs is arranged in rows and columns exhibiting vertical and horizontal symmetry. The display device is especially suitable for miniature helmets such as pocket sized collectable football helmets, however, this should not be considered limiting since the same concepts can be extended to sport helmets of all sizes.

While many of the embodiments shown depict arrangements of rows and columns of pegs for mounting the helmets, the invention should not be considered to be limited to this arrangement. Other arrangements could also be used, including staggered arrangements such as in display 56, and arrangements that do not follow a row or column format as in displays 52 and 54, and even single helmet displays. Also, although the present display device has been described with dimensions and peg sizes and angles suitable for the standard Pocket Pro™ line of football helmets, other miniature or even full size helmets could be similarly displayed by providing an arrangement of pegs or a single peg that is suitably sized to hold the helmet or helmets with a friction or interference fit. For example, special lines of such pocket size helmets are now produced using different sized air holes, but suitable pegs can be devised to provide the appropriate interference fit. Moreover, although the embodiments illustrated show football helmets, the invention can be generally applicable to any type of helmet having an air hole adjacent an ear position (or otherwise located).

Additionally, the rectangular format for the substrate, while visually pleasing and is preferred due to the shape being conducive to ease of manufacture with wooden parts, should not be considered limiting since any shape substrate could be used, including non-planar substrates without limitation. Also, although pegs having round cross-section are preferred and illustrated herein, other cross-sectional shapes such as oval, square, rectangular, octagonal, etc. will function equally well, provided they are appropriately dimensioned to provide an interference fit with the air holes of the helmet. While a wooden substrate with wooden pegs is preferred, and functions well (in part due to the ease of manufacture and the slight compressibility of the wooden pegs) other materials can be utilized without deviating from embodiments consistent with the present invention.

While certain illustrative embodiments have been described, it is evident that many alternatives, modifications, permutations and variations will become apparent to those skilled in the art in light of the foregoing description.

What is claimed is:

1. A display device for displaying a plurality of sport helmets, comprising:

a planar substrate;

a plurality of pegs attached to said substrate and protruding from a surface of said substrate, each said peg having an outer dimension that is suitably sized to create an interference fit with an air hole in the helmet; and the plurality of sport helmets attached to the plurality of pegs, respectively, by the interference fit with the air hole so as to display the plurality of sport helmets.

2. The display device according to claim 1, wherein the substrate includes a planar surface, and wherein the plurality of pegs are attached to the planar surface.

3. The display device according to claim 2, wherein the plurality of pegs are disposed at an angle other than 90 degrees with respect to the plane of the substrate.

4. The display device according to claim 3, wherein the angle comprises approximately 15 degrees from perpendicular to the substrate, with the pegs being oriented parallel with a plane of horizontal orientation of the display device.

5. The display device according to claim 2, wherein the plurality of pegs comprises a first and second plurality of pegs attached to the substrate's planar surface, and wherein the first plurality of pegs are disposed at a first angle with respect to the plane of the substrate, and wherein the second plurality of pegs are disposed at a second angle with respect to the substrate.

6. The display device according to claim 5, wherein the first angle comprises approximately 15 degrees from perpendicular to the substrate, and wherein the second angle comprises −15 degrees from perpendicular to the substrate, with all pegs being oriented parallel with a plane of horizontal orientation of the planar substrate of the display device.

7. The display device according to claim 6, wherein the first and second angles are oriented so that the helmets mounted to the first plurality of pegs face the helmets mounted to the second plurality of pegs.

8. The display device according to claim 1, wherein the substrate is in the shape of the outline of a sport related article.

9. The display device according to claim 8, wherein the sport related article comprises one of a home plate, a football, an athletic field, a baseball, a baseball glove, a baseball bat, and a hockey stick.

10. The display device according to claim 8, wherein the substrate bears indicia that reinforces the similarity of the shape to the outline of the sport related article.

11. The display device according to claim 1, wherein the plurality of pegs are arranged in rows and columns exhibiting at least one of vertical and horizontal symmetry.

12. A display device for displaying at least one sport helmet, comprising:

an entirely planar substrate having a planar surface;

at least one peg attached to said substrate and protruding from the planar surface of said substrate, each said peg having an outer dimension that is suitably sized to create an interference fit with an air hole in the helmet; and the at least one sport helmet attached to the at least one peg by the interference fit with the air hole so as to display the at least one sport helmet.

13. The display device according to claim 12, wherein the at least one peg comprises a plurality of pegs attached to the substrate's planar surface, and wherein the plurality of pegs are disposed at an angle other than 90 degrees with respect to the plane of the substrate.

14. The display device according to claim 13, wherein the angle comprises approximately 15 degrees from perpendicular to the substrate, with the pegs being oriented parallel with a plane of horizontal orientation of the display device.

15. The display device according to claim 12, wherein the at least one peg comprises a first and second plurality of pegs attached to the substrate's planar surface, and wherein the first plurality of pegs are disposed at a first angle with respect to the plane of the substrate, and wherein the second plurality of pegs are disposed at a second angle with respect to the substrate.

16. The display device according to claim 15, wherein the first angle comprises approximately 15 degrees from perpendicular to the substrate, and wherein the second angle comprises −15 degrees from perpendicular to the substrate, with all pegs being oriented parallel with a plane of horizontal orientation of the display device.

17. The display device according to claim 16, wherein the first and second angles are oriented so that the helmets mounted to the first plurality of pegs face the helmets mounted to the second plurality of pegs.

18. The display device according to claim 12, wherein the substrate is in the shape of the outline of a sport related article.

19. The display device according to claim 12, wherein the at least one peg comprises a plurality of pegs attached to the substrate, and wherein the plurality of pegs are arranged in rows and columns exhibiting at least one of vertical and horizontal symmetry.

20. A display kit for displaying at least one sport helmet, the kit comprising:

an entirely planar substrate;

at least one peg attached to said substrate and protruding from a surface of said substrate, each said peg having an outer dimension that is suitably sized to create an interference fit with an air hole in the helmet; and the at least one sport helmet attached to the at least one peg by the interference fit with the air hole so as to display the at least one sport helmet.

21. The display kit according to claim 20, wherein the entirely planar substrate includes a planar surface, and wherein the at least one peg is attached to the planar surface.

22. The display kit according to claim 21, wherein the at least one peg comprises a plurality of pegs attached to the substrate's planar surface, and wherein the plurality of pegs are disposed at an angle other than 90 degrees with respect to the plane of the substrate.

23. The display kit according to claim 22, wherein the angle comprises approximately 15 degrees from perpendicular to the substrate, with the pegs being oriented parallel with a plane of horizontal orientation of the display device.

24. The display kit according to claim 20, wherein the at least one peg comprises a first and second plurality of pegs attached to the substrate's planar surface, and wherein the first plurality of pegs are disposed at a first angle with respect to the plane of the substrate, and wherein the second plurality of pegs are disposed at a second angle with respect to the substrate.

25. The display kit according to claim 24, wherein the first angle comprises approximately 15 degrees from perpendicular to the substrate, and wherein the second angle comprises −15 degrees from perpendicular to the substrate, with all pegs being oriented parallel with a plane of horizontal orientation of the display device.

26. The display kit according to claim 24, wherein the first and second angles are oriented so that helmets mounted to the first plurality of pegs face helmets mounted to the second plurality of pegs.

27. The display kit according to claim 20, wherein the substrate is in the shape of the outline of a sport related article.

28. The display kit according to claim 20, wherein the at least one peg comprises a plurality of pegs attached to the substrate, and wherein the plurality of pegs are arranged in rows and columns exhibiting at least one of vertical and horizontal symmetry.

* * * * *